US006266972B1

(12) United States Patent
Bostic

(10) Patent No.: US 6,266,972 B1
(45) Date of Patent: Jul. 31, 2001

(54) MODULAR FREEZER PALLET AND METHOD FOR STORING PERISHABLE ITEMS

(75) Inventor: William M. Bostic, Asheboro, NC (US)

(73) Assignee: Vesture Corporation, Asheboro, NC (US)

( * ) Notice: Subject to any disclaimer, the term of this patent is extended or adjusted under 35 U.S.C. 154(b) by 0 days.

(21) Appl. No.: 09/206,685

(22) Filed: Dec. 7, 1998

(51) Int. Cl.[7] ..... F25D 3/08
(52) U.S. Cl. ..... 62/371; 62/530
(58) Field of Search ..... 62/371, 372, 530, 62/457.2, 60

(56) References Cited

U.S. PATENT DOCUMENTS

| | | | | |
|---|---|---|---|---|
| 2,632,311 | | 3/1953 | Sullivan . | |
| 2,951,608 | | 9/1960 | Morrison . | |
| 3,280,586 | * | 10/1966 | Funakoshi | 62/371 |
| 4,498,312 | * | 2/1985 | Schlosser | 62/371 |
| 4,531,278 | | 7/1985 | Boykin . | |
| 4,809,851 | * | 3/1989 | Oestreich et al. | 206/599 |
| 5,031,776 | | 7/1991 | Morgan, IV . | |
| 5,050,387 | * | 9/1991 | Bruce | 62/60 |
| 5,058,746 | | 10/1991 | Morgan, IV . | |
| 5,088,301 | * | 2/1992 | Piepenbrink | 62/457.6 |
| 5,235,819 | * | 8/1993 | Bruce | 62/60 |
| 5,267,663 | | 12/1993 | Dykhouse . | |
| 5,275,302 | | 1/1994 | Ulitz . | |
| 5,279,437 | | 1/1994 | Kupersmit . | |
| 5,285,656 | | 2/1994 | Peters . | |
| 5,287,981 | | 2/1994 | Wheeler . | |
| 5,289,933 | * | 3/1994 | Streich et al. | 220/1.5 |
| 5,413,236 | | 5/1995 | Kenevan . | |
| 5,449,081 | | 9/1995 | Sjostedt et al. . | |
| 5,570,588 | * | 11/1996 | Lowe | 62/457.7 |
| 5,642,827 | | 7/1997 | Madsen . | |

OTHER PUBLICATIONS

Banner Metals, Inc., *Thomas Register 1995*.
Convoy Plastic Pallets, Watertown, WI, *Thomas Register 1995*.
Dominion Pallet, Inc. Mineral, VA, Quality Wood Pallets, *Thomas Register 1995*, 22891/PAL.
Stratis Corporation Plastic Pallets, Benefits of Stratis, Indianapolis, IN, *Thomas Register 1995*, 22879/PAL.
Stratis Corporation Plastic Pallets, Benefits of Stratis, Indianapolis, IN, *Thomas Register 1995*, 22883/PAL.
Stratis Corporation Plastics Pallets, Benefits of Stratis, Indianapolis, IN, *Thomas Register 1995*, 22887/PAL.
Stratis Corporation Plastic Pallets, Nestable Pallets, Indianapolis, IN, *Thomas Register 1995*, 22881/PAL.
Stratis Corporation Plastic Pallets, Rackable Pallets, Indianapolis, IN, *Thomas Register 1995*, 22889/PAL.
Stratis Corporation Plastics Pallets, Stackable Pallets, Indianapolis, IN, *Thomas Register 1995*, 22885/PAL.
TriEnda Corporation, Portage, WI, *Thomas Register 1995*, 22893/PAL.

* cited by examiner

*Primary Examiner*—William Doerrler
(74) *Attorney, Agent, or Firm*—Merchant & Gould P.C.

(57) ABSTRACT

A modular freezer pallet having an interior perishable item storage area is provided. The modular freezer pallet includes a heat sink material for maintaining the interior perishable item storage area at a desired temperature for storage of perishable items. The heat sink material preferably maintains the interior perishable item storage area at a temperature of less than about 38° F. for 48 hours in an ambient environment of one atmosphere and 70° F. A method for storing perishable items is provided.

14 Claims, 6 Drawing Sheets

MODULAR FREEZER PALLET AND METHOD FOR STORING PERISHABLE ITEMS

FIELD OF THE INVENTION

This invention relates to a modular freezer pallet and to a method for storage of perishable items. More particularly, the modular freezer pallet includes a heat sink material for maintaining the interior perishable item storage area at a desired temperature for storage of perishable items.

BACKGROUND OF THE INVENTION

Perishable food items are generally provided in refrigerated containers during overseas transportation or over-the-highway transportation. Commercially available refrigerated containers for this purpose are available from Ciana Corporation. U.S. Pat. No. 5,642,827 to Madsen describes a double-walled refrigerated container.

Perishable food items have additionally been transported and/or stored in insulated containers. Exemplary insulated containers are described by U.S. Pat. No. 2,951,608 to Morrison; U.S. Pat. No. 2,632,311 to Sullivan; U.S. Pat. No. 5,258,656 to Peters; and U.S. Pat. No. 5,449,081 to Sjostedt et al. In general, these insulated containers function as coolers. That is, the insulated containers are generally intended to decrease thermal loss, and maintain the cargo at its desired temperature. Often, ice or dry ice can be incorporated in the insulated containers in order to maintain the temperature therein. The use of ice or dry ice during in connection with air transportation is increasingly becoming discouraged.

Numerous collapsible or knock-down cargo containers are available. Several of them are even insulated. Exemplary collapsible or knock-down cargo containers are described by U.S. Pat. No. 5,279,437 to Kupersmit; U.S. Pat. No. 4,531,278 to Boykin; U.S. Pat. No. 5,058,746 to Morgan, IV; U.S. Pat. No. 4,809,851 to Oestreich, Jr. et al.; U.S. Pat. No. 5,413,236 to Kenevan; U.S. Pat. No. 5,031,776 to Morgan, IV; U.S. Pat. No. 5,267,663 to Dykhouse; U.S. Pat. No. 5,289,933 to Streich et al.; U.S. Pat. No. 5,287,981 to Wheeler; and U.S. Pat. No. 5,275,302 to Uitz.

SUMMARY OF THE INVENTION

A modular freezer pallet is provided by the invention. The modular freezer pallet includes a base unit, a plurality of wall units, and a cover unit. The units are constructed and arranged to provide a pallet structure having an interior perishable item storage area. At least one of the units includes a heat sink material for maintaining the interior perishable item storage area at a temperature of less than about 38° F. for 48 hours in an ambient environment of one atmosphere at 70° F.

A method for storing perishable items is provided by the invention. The method includes providing an assembled modular freezer pallet comprising a base unit, plurality of wall units, and a cover unit. The units are constructed and arranged to provide a pallet structure having an interior perishable food item storage area, and at least one of the units comprises a heat sink material for maintaining the interior perishable item storage area at a temperature of less than about 38° F. for 48 hours in an ambient environment of one atmosphere and 70° F. The method additionally includes providing perishable items within the interior perishable item storage area.

DETAILED DESCRIPTION OF THE INVENTION

Figure 1:
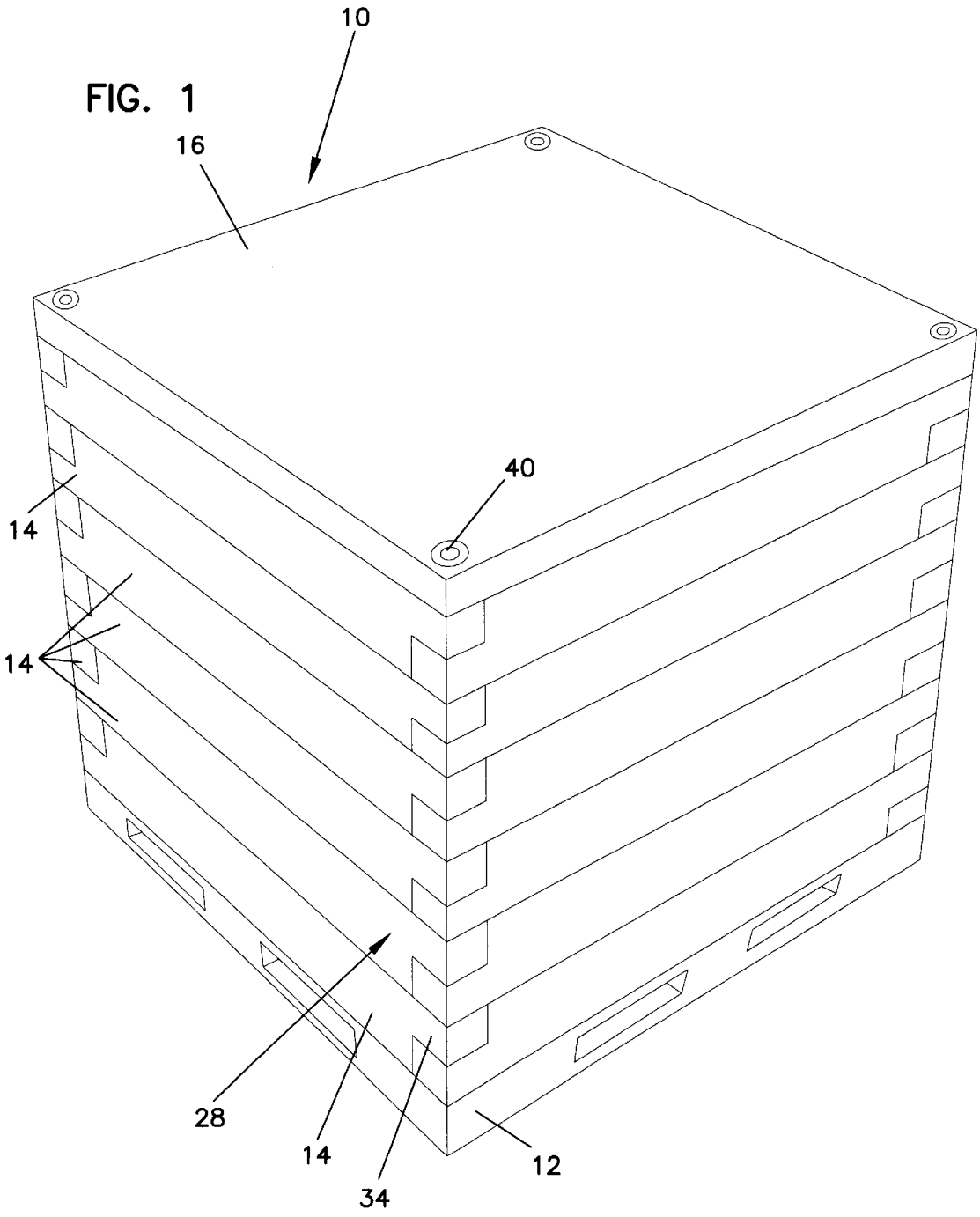
FIG. 1 is a perspective view of an assembled, modular freezer pallet according to the principles of the present invention.

The invention is directed at a modular freezer pallet which can be used for transporting perishable goods. It should be understood that the phrase "perishable goods" refers to any type of goods which are temperature sensitive and in particular those which rapidly deteriorate as the temperature changes. Exemplary types of perishable containers include agricultural produce such as fruit, vegetables, and flowers, meat and fish products, beverages, and medical and/or scientific materials or tissues.

Now referring to FIGS. 1–6, a modular freezer pallet is indicated at reference numeral 10. The modular freezer pallet 10 can be referred to as the pallet. By "modular," it is meant that the freezer pallet can be broken down into component parts which can then be reassembled. Accordingly, the modular freezer pallet 10 can be disassembled and later reassembled. Preferably, each component of the modular freezer pallet 10 can be handled by an individual without assistance from another person.

The modular freezer pallet 10 includes a base unit 12, a plurality of wall units 14, and a cover unit 16. When the base unit 12, wall units 14, and cover unit 16 are assembled, an internal volume or perishable food storage area 18 is provided. This is the area in which perishable foods can be stored for a length of time in a cool environment. In a preferred embodiment, the wall units 14 are all provided with the same dimension. This allows one to have a single design wall unit 14 in stock. Preferably, the wall units 14 interlock with each other. An advantage of the present invention is that many of the components are essentially interchangeable. By providing wall units 14 which are interchangeable, it is expected that fewer parts need to be inventoried and the assembly of the pallet will be more convenient.

The base unit 12 and the cover unit 16 are primarily responsible for defining the width and length of the freezer pallet, but the height of the freezer pallet can be adjusted by incorporating the desired number of wall units 14. The wall units 14 are preferably of the same dimension and can be used to adjust the height of the freezer pallet 10. The height can be increased by adding additional wall units 14. Accordingly, it should be appreciated that the freezer pallet of the invention can be characterized as having an adjustable height.

Figure 2:
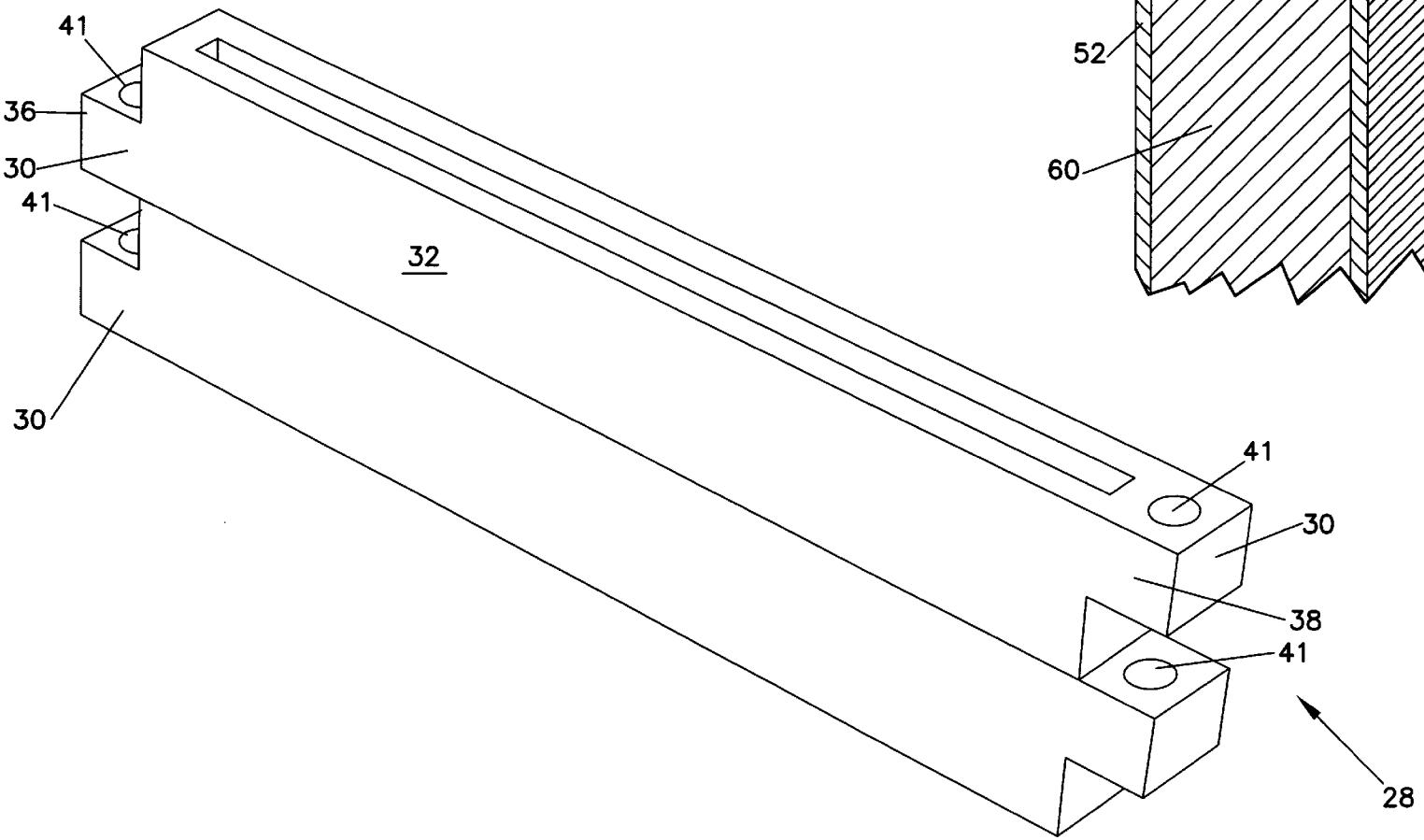
FIG. 2 is a perspective view of a partially assembled side of the modular freezer pallet of FIG. 1.
Figure 4:
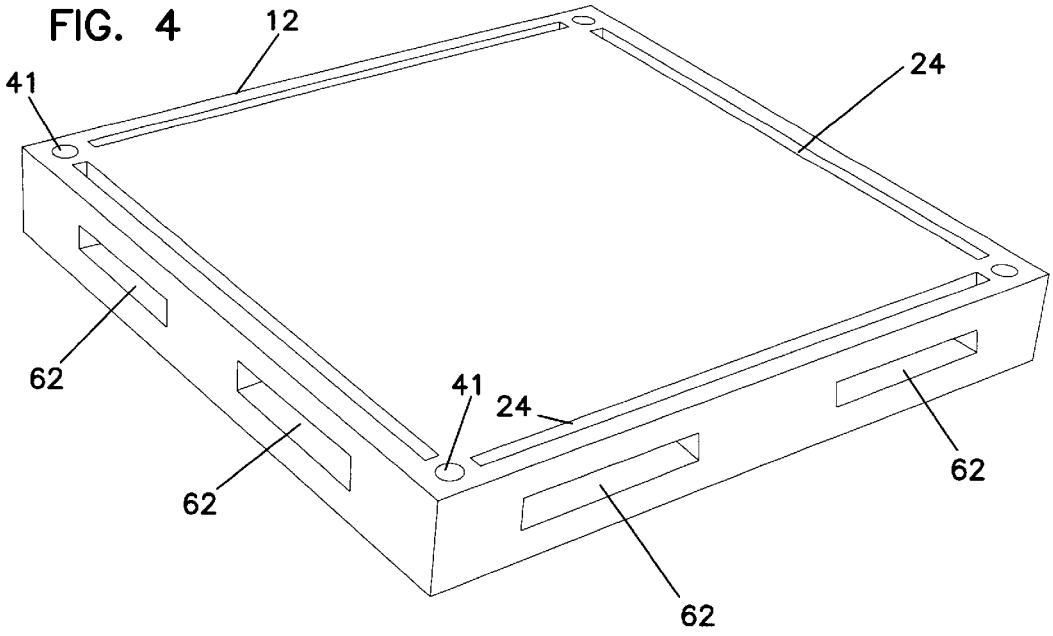
FIG. 4 is a perspective view of the base unit of the modular freezer pallet of FIG. 1.
Figure 6:
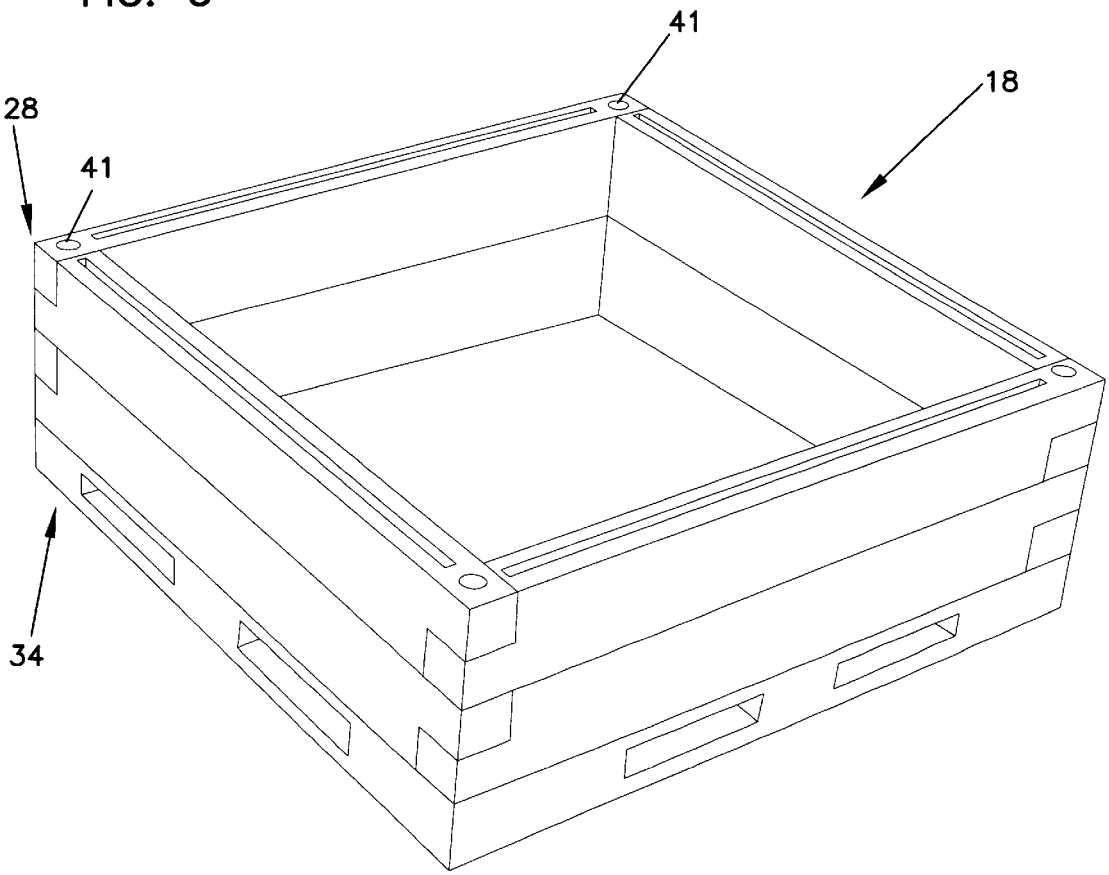
FIG. 6 is a perspective view of the partially assembled modular freezer pallet of FIG. 1.
Figure 5:
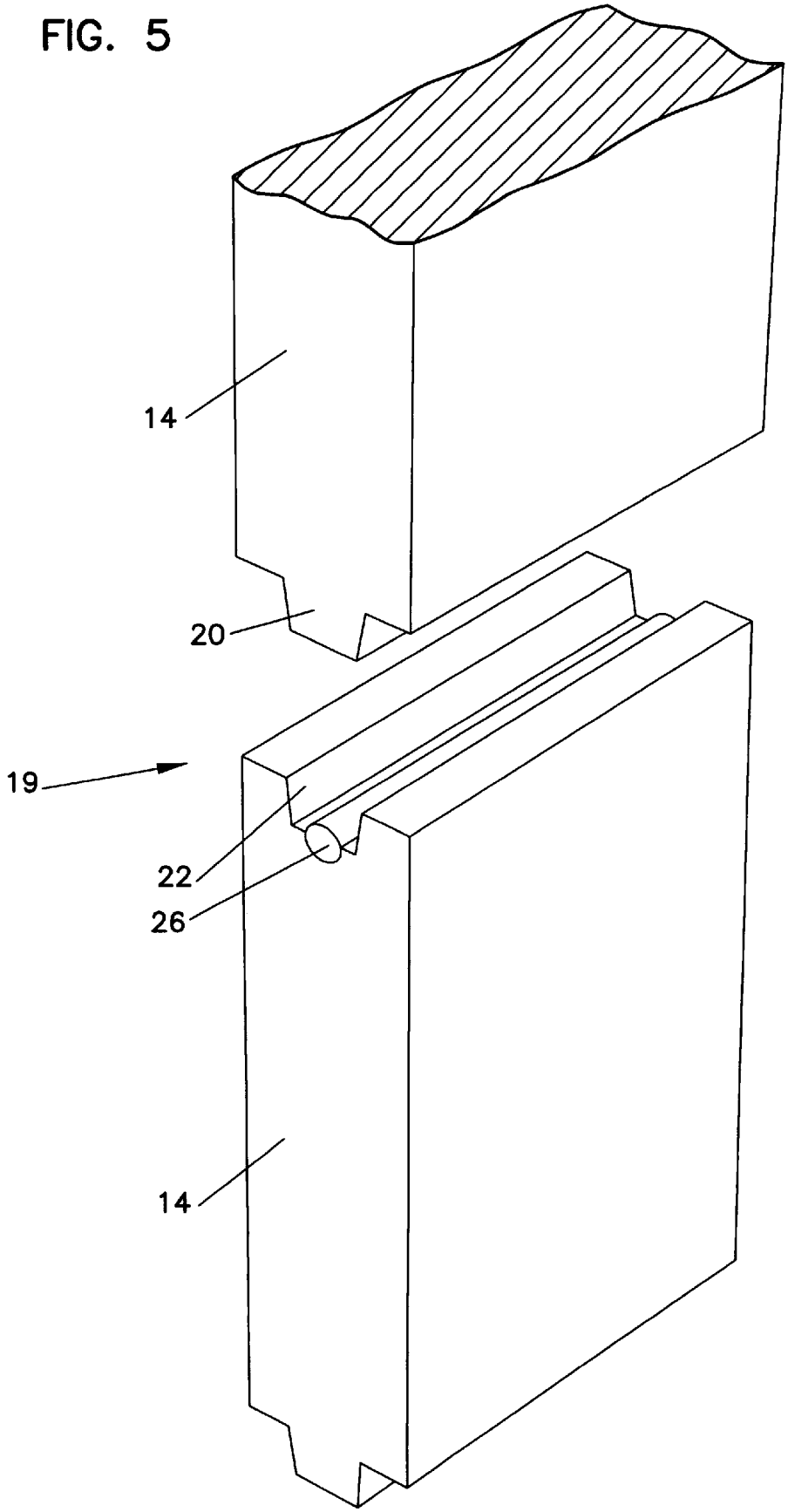
FIG. 5 is an exploded view of the wall of the modular freezer pallet of FIG. 1.

The wall units 14 are preferably provided as identical structures. As shown in FIGS. 2 and 5, the wall units 14 are provided with a tongue and groove arrangement 19 including a wall tongue 20 and a wall groove 22. The wall tongue 20 extends into the wall groove 22 provided on another wall unit 14 or into the base groove 24 provided in the base unit 12. This allows the wall units 14 to be stacked on top of each other to increase the height of the pallet 10. This tongue and groove arrangement is advantageous because it provides reinforcement for the pallet 10, thereby restricting movement of wall units 14. During shipping, certain forces acting on the pallet 10 tend to cause movement of the wall units 14. The forces can result from turning and from bumps encountered in over the road and air travel. The wall groove 22 and the base groove 24 preferably include a strip or gasket 26 for reducing flow of warm air into the internal volume 18.

The ends of each wall unit 14 are preferably provided with an interlocking arrangement 28. The interlocking arrangement 28 refers to the arms 30 provided on the wall units 14. The arms 30 are provided to extend beyond the wall section 32 to form the corners 34. The arms 30 are preferably arranged alternately on each wall unit 14. That is, each wall unit 14 includes a first arm 36 provided on one side in proximity to the tongue 20, and a second arm 38 provided on the other side in proximity to the wall groove 22.

Locking pins 40 can be provided extending through locking pin holes 41 in the arms 30 for locking the components of the modular freezer pallet 10 together. Thus, once the base unit 12, wall units 14, and cover unit 16 of the modular freezer pallet 10 are assembled, the locking pins 40 are inserted through the locking pin holes 41 in each corner 34 of the pallet to hold the pallet together. The locking pins 40 can be held in place by spring loaded detents. Alternatively, the locking pins can be provided as a series of pins, each pin being attached to a wall unit and provided for attaching the wall unit to another wall unit. With or without the use of locking pins 40, it should be appreciated that pallet wrapping film and/or bands can be used to wrap the modular freezer pallet 10 in order to keep the parts together. An alternative technique for locking the wall sections together is to incorporate into each wall unit a separate quarter turn locking pin. Thus, as each wall unit is assembled, the locking pin provided on each wall unit can be adjusted to lock the wall unit in place.

The modular freezer pallet 10 is advantageous in that it can be broken down into its components which can then be placed in a freezer and allowed to freeze. It is expected that in most applications, the fully assembled modular freezer pallet may be too large to introduce into a freezer. The base unit 12, wall units 14, and cover units 16 are preferably of a size which allows them to be individually provided inside a freezer. In certain situations, it is expected that the base unit 12 and cover unit 16 may be too large to fit within a freezer. This may be because the freezer is too small or the base unit 12 and the cover unit 16 are too large. In such a situation, it is the wall units 14 which may be provided in the freezer for charging, and the base unit 12 and cover unit 16 can be left uncharged. In this situation, it is expected that the pallet 10 will still provided desired cooling but for a shorter period of time.

It is an advantage of the invention that the pallet 10 can be disassembled and the individual units can be charged. By disassembling the pallet 10, the internal volume 18 can be eliminated and more space inside the freezer can be utilized. In addition, certain freezers may not be large enough to accommodate a fully assembled pallet 10. It should be appreciated, however, that while a preferred embodiment of the invention is described in the context of a freezer pallet which can be disassembled and reassembled, the invention additionally includes a freezer pallet which is provided as a structure which does not easily disassemble. The freezer pallet can be provided as a structure which will not break down without considerable effort or breaking the structure.

Figure 3:
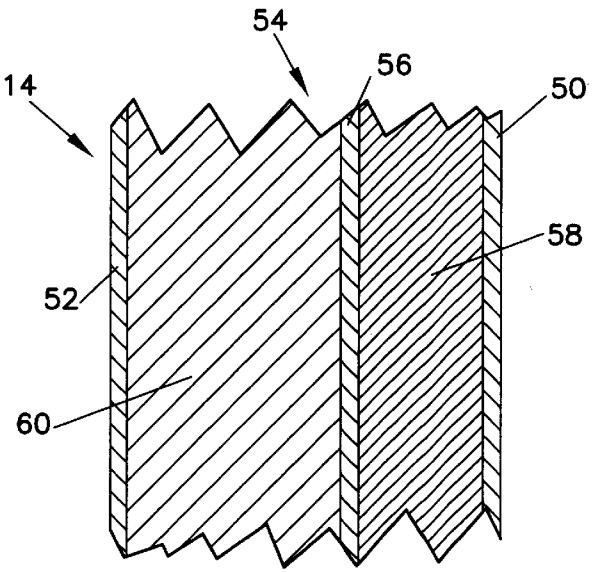
FIG. 3 is a sectional view of a wall of the modular freezer pallet of FIG. 1.

Now referring to FIG. 3, the wall unit 14 is shown including an inner wall 50 and an outer wall 52. The inner wall 50 is intended to form the interior surface of the modular freezer pallet 10. The outer wall 52 is intended to form the exterior surface of the modular freezer pallet 10 and is expected to remain in contact with the ambient atmosphere. In general, it is expected that the walls can be formed of any suitable polymeric material including engineering plastics. A preferred material includes polyethylene because it can withstand the temperatures of operation and can be provided in the desired configuration by blow molding.

The outer wall 52 and the inner wall 50 form an interior region 54 which receives a heat sink material 58. The heat sink material 58 is preferably a lightweight material which utilizes latent energy in order to provide desired cooling. A lightweight material utilizing latent energy can be characterized as a phase change material because it will undergo a change in phase from the solid state to the liquid state as it is used to keep perishable items cool. By utilizing a phase change material, Applicants have been able to take advantage of the latent heat associated with a change in phase. Exemplary phase change materials include a brine solution, a polymer material, a wax material, and glycol solution. Exemplary brine solutions include potassium or sodium chloride in water. Preferably, the phase change material is water or contains mostly water. Exemplary polymer materials include polywax, polyalkylenes such as polyethylene and/or polypropylene, and paraffin containing materials.

The wall unit 14 preferably includes a layer of insulation 60 between the outer wall 52 and the heat sink material 58. It should be appreciated that the presence of insulation is not a requirement. The presence of a layer of insulation 60 is advantageous because it helps slow the migration of heat from the warm ambient environment into the heat sink material 58. A preferred insulation material can be referred to as a vacuum insulation panel and is available under the name Instill™ from The Dow Chemical Company. Other insulation materials include foam materials including polyisocyanurate, polyurethane, or polystyrene foams. The heat sink material 58 and the layer of insulation 60 can be separated by an interior wall 56. Alternatively, an interior wall 56 may not be needed if the layer of insulation 60 can adequately contain the heat sink material 58 near the inner wall 50.

Figure 7:
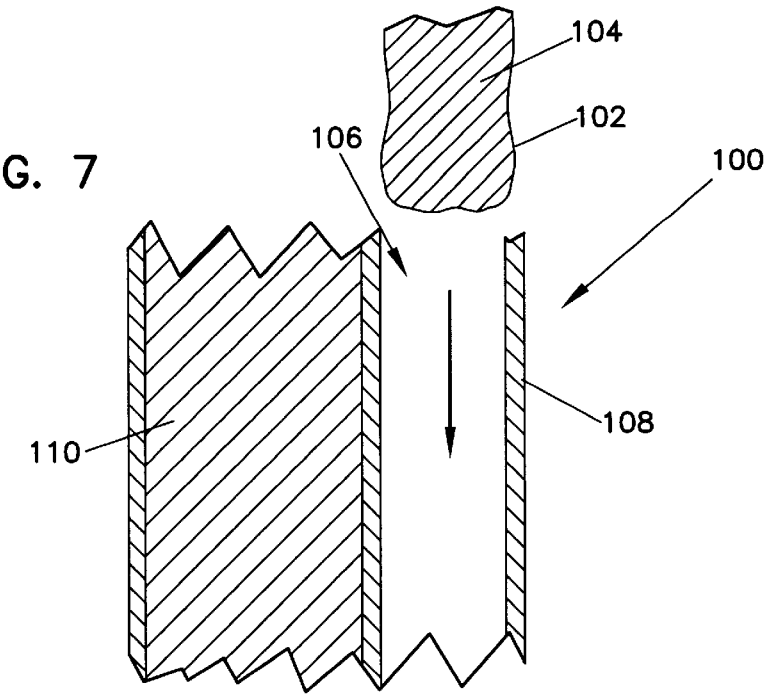
FIG. 7 is a sectional view of an alternative embodiment of a wall of a modular freezer pallet according to principles of the present invention.
Figure 8:
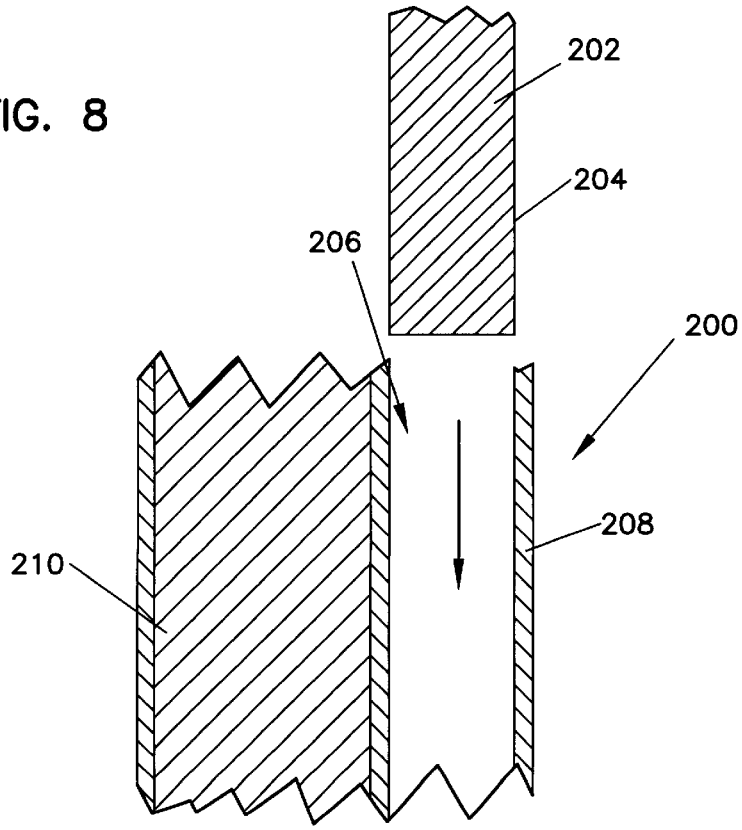
FIG. 8 is a sectional view of an alternative embodiment of a wall of a modular freezer pallet according to principles of the present invention.
Figure 9:
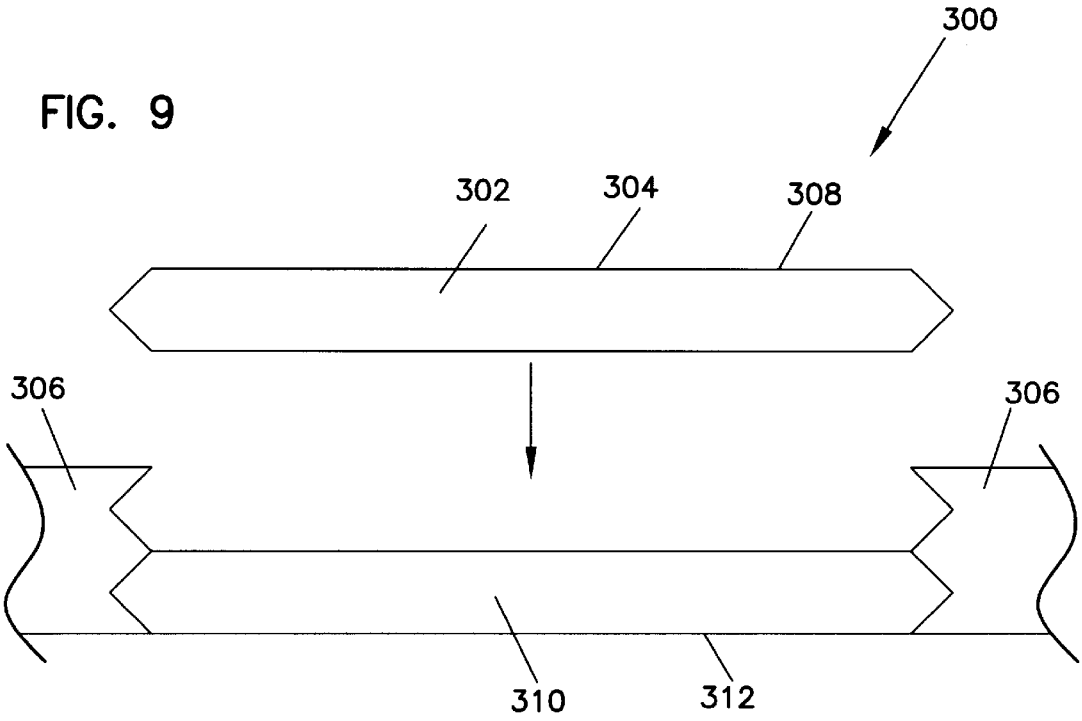
FIG. 9 is a sectional view of an alternative embodiment of a wall of a modular freezer pallet according to principles of the present invention.

Alternative wall units 100, 200, and 300 are shown in FIGS. 7–9. The wall unit 100 includes the heat sink material 102 provided in a sealed bag 104. The sealed bag 104 is preferably a material which can contain the heat sink material 102 through a wide range of temperatures encountered during operation of the pallet without cracking or releasing the heat sink material 102. Exemplary materials for providing such a sealed bag include metalasine/nylon laminate film or polyethylene sealant packaging films. Preferably, the polyethylene sealant packaging films include a layer of nylon for strength. The sealed bag 104 can be charged in a freezer and then inserted within the heat sink receiving area 106 between the inner wall 108 and the insulation 110.

The wall unit 200 is similar to the wall unit 100 but the heat sink material 202 is provided in a container 204 which maintains the desired shape of the heat sink material 202. Accordingly, the container 204 can be independently charged in a freezer and then slid within the heat sink receiving area 206. The heat sink material 204 is preferably provided adjacent the inner wall 208 and the insulation 210.

Another embodiment of the invention is depicted by wall unit 300 in FIG. 9. Wall unit 300 is shown as a top, sectional view. The heat sink material 302 is provided within a container 304 which provides a desired shape for the heat sink material 302 which allows it to conform and slide between the wall ends 306. Accordingly, the container 304 forms the inner wall 308 of the wall unit. Furthermore, the insulation 310 is preferably provided adjacent the heat sink material 302, and the insulation 310 is preferably provided adjacent to the outer wall 312.

The base unit 12 and cover unit 16 can be provided with a heat sink material. It is expected that in certain applications, the base unit 12 and cover unit 16 may be too large to conveniently place in a freezer. In such circumstances, the base unit 12 and cover unit 16 may include insulation in order to maintain the temperature of the perishable item storage area 18. The base unit 12 preferably includes forklift receiving slots 62. This allows a modular freezing pallet to be lifted and transported and/or stacked using a forklift.

It is expected that the modular freezer pallet 10 may be used in various applications including transportation by over-the-highway truck, airplane and hand truck. In the case of hand truck transportation, it is expected that the internal volume 18 of the modular freezer pallet 10 will have a size of between about 4 $ft^3$ and about 20 $ft^3$. In the case where the modular freezer pallet 10 will be transported by over-the-highway truck or airplane, it is expected that the internal volume 18 will have a range of between about 16 $ft^3$ and about 84 $ft^3$. It should be appreciated that the smaller sized freezer pallet (i.e., about 4 $ft^3$ to about 20 $ft^3$) can be transported by over-the-highway truck or airplane. Furthermore, it should be understood that the exterior side of the modular freezer pallet 10 can be configured so that it fits within the fuselage of an airplane. In general, cargo which is transported by airplane often includes a side which conforms to the curvature of the fuselage of the cargo area of the airplane.

Furthermore, the modular freezer pallet of the invention is expected to provide a maximum 38° F. and minimum 0° F. environment for at least 48 hours at an ambient temperature of 70° F. and one atmosphere.

The foregoing description, which has been disclosed by way of the above discussion, addresses embodiments of the invention encompassing the principles of the present invention. The embodiments may be changed, modified and/or implemented using various types of arrangements. Those skilled in the art will readily recognize various modifications and changes which may be made to the present invention without strictly following exemplary embodiments and applications illustrated and described herein, and without departing from the spirit and scope of the present invention which is set forth in the following claims.

What is claimed is:

1. A modular freezer pallet comprising:

(a) base unit forming a base for the pallet;

(b) plurality of wall units extending from the base unit and forming walls for the pallet, at least a portion of the plurality of wall units comprise:

(i) an inner wall, an outer wall, and interior region provided between the inner wall and the outer wall, and a heat sink material provided within the interior region; and (ii) tongue and groove arrangement for stacking a wall unit on top of another wall unit to form a side of the pallet to provide a wall having at least two stacked wall units; and (iii) an interlocking arrangement provided on ends of the wall units, wherein the interlocking arrangement comprises an arm extending from one wall unit provided adjacent to an arm extending from another wall unit;

(c) cover unit forming a cover for the pallet;

wherein said base unit, plurality of wall units, and cover unit provide a pallet structure having an interior perishable item storage area which can be maintained at a temperature of less than about 38° F. for 48 hours in an ambient environment of 1 atmosphere and 70° F.

2. A modular freezer pallet according to claim 1, wherein the base unit, plurality of wall units, and cover unit are held in place by locking pins.

3. A method for storing perishable items, the method comprising steps of:

providing an assembled modular freezer pallet comprising:

(a) base unit forming a base for the freezer pallet;

(b) plurality of wall units extending from the base unit and forming walls for the pallet, at least a portion of the plurality of wall units comprise:

(i) an inner wall, an outer wall, and interior region provided between the inner wall and the outer wall, and a heat sink material provided within the interior region; and (ii) tongue and groove arrangement for stacking a wall unit on top of another wall unit to form a side of the pallet to provide a wall having at least two stacked wall units; and (iii) an interlocking arrangement provided on ends of the wall units, wherein the interlocking arrangement comprises an arm extending from one wall unit provided adjacent to an arm extending from another wall unit;

(c) cover unit forming a cover for the pallet;

wherein the base unit, the plurality of wall units, and the cover provide an interior perishable item storage area that can be maintained at a temperature of less than about 38° F. for 48 hours in an ambient environment of 1 atmosphere and 70° F; and providing perishable items within the interior perishable item storage area.

4. A modular freezer pallet according to claim 1, wherein said plurality of wall units are provided with a heat sink material comprising a phase change material.

5. A modular freezer pallet according to claim 1, wherein said perishable item storage area provides a volume of greater than about 4 $ft.^3$.

6. A modular freezer pallet according to claim 1, wherein said perishable item storage area provides a volume of less than about 84 $ft.^3$.

7. A modular freezer pallet according to claim 1, wherein said heat sink material comprises a brine solution.

8. A modular freezer pallet according to claim 1, wherein said heat sink material is provided within a sealed bag.

9. A modular freezer pallet according to claim 1, wherein said heat sink material is provided within a container for maintaining a desired shape of said heat sink material.

10. A modular freezer pallet according to claim 1, wherein said base unit includes forklift receiving slots.

11. A method for storing perishable items according to claim 3, further comprising a step of:

(a) charging said plurality of wall units by placing said plurality of wall units in a reduced temperature environment.

12. A method for storing perishable items according to claim 3, wherein said heat sink material comprises a brine solution.

13. A method for storing perishable items according to claim 3, wherein said heat sink material comprises a phase change material.

14. A method for storing perishable items according to claim 3, wherein said plurality of wall units include said heat sink material and insulation.

* * * * *